US006024829A

United States Patent [19]

Easter et al.

[11] Patent Number: 6,024,829

[45] Date of Patent: Feb. 15, 2000

[54] METHOD OF REDUCING AGGLOMERATE PARTICLES IN A POLISHING SLURRY

[75] Inventors: William G. Easter; John A. Maze, both of Orlando, Fla.

[73] Assignee: Lucent Technologies Inc., Murray Hill, N.J.

[21] Appl. No.: 09/083,072

[22] Filed: May 21, 1998

[51] Int. Cl.[7] ..... B24D 17/00; H01L 21/00

[52] U.S. Cl. ..... 156/345; 216/88; 216/89; 451/289

[58] Field of Search ..... 438/692, 693, 438/746, 747; 216/88, 89, 90; 451/41, 289; 156/345 LP

[56] References Cited

U.S. PATENT DOCUMENTS

| | | | |
|---|---|---|---|
| 5,245,790 | 9/1993 | Jerbic | 51/121 |
| 5,245,796 | 9/1993 | Miller et al. | 51/283 |
| 5,674,115 | 10/1997 | Yamashita et al. | 451/289 |
| 5,738,573 | 4/1998 | Yueh | 451/287 |

OTHER PUBLICATIONS

Halliday, David and Resnick, Robert. Fundamentals of Physics, John Wiley & Sons, Inc. p. 323, Jan. 1, 1970.

*Primary Examiner*—Bruce Breneman
*Assistant Examiner*—Alva C Powell

[57] ABSTRACT

The present invention, in one embodiment, provides a method for eliminating agglomerate particles in a polishing slurry. In this particular embodiment, the method includes transferring a slurry that has a design particle size from a slurry source to an energy source. In many instances, the slurry forms an agglomerate that has an agglomerated particle size, which is substantially larger than the design particle size. This larger particle size is highly undesirable because it can damage the semiconductor wafer surface as it is polished. The method further includes subjecting the agglomerate to energy, such as an ultra sonic wave emanating from the energy source, and transferring energy from the energy source to the slurry to reduce the agglomerated particle size to substantially the design particle size.

26 Claims, 3 Drawing Sheets

| 210 | 220 | 230 | 240 | 250 | 260 | 270 |
|---|---|---|---|---|---|---|
| PRODUCT | ABRASIVE | MEDIUM | CONCENTRATION (PERCENT) | pH | PARTICLE SIZE (MICRONS) | USE |
| MET-200 | ALUMINA | FERRIC NITRATE | 20 | 3.5-4.0 | 1.5 | TUNGSTEN (W) |
| MET-401 | ALUMINA | FERRIC NITRATE | 20 | 3.5-4.0 | 1.15 | COPPER (Cu) |
| MET-202 | ALUMINA | FERRIC NITRATE | 20 | 3.5-4.0 | 0.12 | ALUMINUM or W |
| MET-302 | ALUMINA | FERRIC NITRATE | 20 | 3.5-4.0 | 0.12 | TUNGSTEN |
| KLEBOSOL® 30N50 | AMORPHOUS SILICA | AMMONIUM HYDROXIDE | 30 | 10 | 0.05 | DIELECTRIC-TEOS, BPSG, etc. |
| KLEBOSOL® 30N50 pHN | AMORPHOUS SILICA | AMMONIUM HYDROXIDE | 30 | 11 | 0.05 | DIELECTRIC |
| KLEBOSOL® 30N25 | AMORPHOUS SILICA | AMMONIUM HYDROXIDE | 30 | 10 | 0.025 | DIELECTRIC |
| KLEBOSOL® 30N12 | AMORPHOUS SILICA | AMMONIUM HYDROXIDE | 30 | 10 | 0.012 | DIELECTRIC |
| KLEBOSOL® 30H50 | AMORPHOUS SILICA | PROPRIETARY H+ | 30 | 2 | 0.05 | SPECIAL DIELECTRIC SURFACING |
| KLEBOSOL® 30H25 | AMORPHOUS SILICA | PROPRIETARY H+ | 30 | 2 | 0.025 | POST-METAL DIELECTRIC |
| KLEBOSOL® 20H12 | AMORPHOUS SILICA | PROPRIETARY H+ | 20 | 2 | 0.012 | POST-METAL DIELECTRIC |
| KLEBOSOL® 1498 | AMORPHOUS SILICA | PROPRIETARY | 30 | 7 | 0.05 | POLYSILICON |
| KLEBOSOL® 50R50 | AMORPHOUS SILICA | SODIUM HYDROXIDE | 50 | 9 | 0.05 | STOCK REMOVAL |
| KLEBOSOL® PL1501 | AMORPHOUS SILICA | POTASSIUM HYDROXIDE | 30 | 11 | 0.05 | DIELECTRIC |
| KLEBOSOL® PL1508 | AMORPHOUS SILICA | AMMONIUM HYDROXIDE | 30 | 11 | 0.05 | DIELECTRIC |

NOTE: KLEBOSOL IS A REGISTERED TRADEMARK OF SOCIETE FRANCAISE HOECHST

*FIG. 2*

METHOD OF REDUCING AGGLOMERATE PARTICLES IN A POLISHING SLURRY

TECHNICAL FIELD OF THE INVENTION

The present invention is directed, in general, to a method of semiconductor wafer fabrication and, more specifically to a method of eliminating agglomerate particles in a polishing slurry used for polishing a semiconductor wafer.

BACKGROUND OF THE INVENTION

Today's semiconductor technology is rapidly forcing device sizes below the 0.5 micron level, even to the 0.25 micron size. With device sizes on this order, even higher precision is being demanded of the processes which form and shape the devices and the dielectric layers separating the active devices. In the fabrication of semiconductor components, the various devices are formed in layers upon an underlying substrate typically composed of silicon, germanium, or gallium arsenide. The various discrete devices are interconnected by metal conductor lines to form the desired integrated circuits. The metal conductor lines are further insulated from the next interconnection level by thin films of insulating material deposited by, for example, CVD (Chemical Vapor Deposition) of oxide or application of SOG (Spin On Glass) layers followed by fellow processes. Holes, or vias, formed through the insulating layers provide electrical connectivity between successive conductive interconnection layers. In such microcircuit wiring processes, it is highly desirable that the insulating layers have a smooth surface topography, since it is difficult to lithographically image and pattern layers applied to rough surfaces.

One semiconductor manufacturing process, chemical/mechanical polishing (CMP), is used to provide the necessary smooth semiconductor topographies. CMP can be used for planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers. Semiconductor wafers may also be planarized to: control layer thickness, sharpen the edge of via "plugs," remove a hardmask, remove other material layers, etc. Significantly, a given semiconductor wafer may be planarized several times, such as upon completion of each metal layer. For example, following via formation in a dielectric material layer, a metallization layer is blanket deposited and then CMP is used to produce planar metal studs.

Briefly, the CMP process involves holding and rotating a thin, reasonably flat, semiconductor wafer against a rotating polishing surface. The polishing surface is wetted by a chemical slurry, under controlled chemical, pressure, and temperature conditions. The chemical slurry contains a polishing agent, such as alumina or silica, which is used as the abrasive material. Additionally, the slurry contains selected chemicals which etch or oxidize selected surfaces of the wafer to prepare them for removal by the abrasive. The combination of both a chemical reaction and mechanical removal of the material during polishing, results in superior planarization of the polished surface. In this process it is important to remove a sufficient amount of material to provide a smooth surface, without removing an excessive amount of underlying materials. Accurate material removal is particularly important in today's submicron technologies where the layers between device and metal levels are constantly getting thinner.

One problem area associated with chemical/mechanical polishing is in the area of slurry consistency. The polishing slurry is a suspension of a mechanical abrasive in a liquid chemical agent. The mechanical abrasive, typically alumina or amorphous silica, is chosen having a design particle size specifically to abrade the intended material. The desired particle size is chosen in much the same way that a sandpaper grade is chosen to give a particular smoothness of finish on wood, metal, or paint. If the particle size is too small, the polishing process will proceed too slowly or not at all. However, if the particle size is too large, desirable semiconductor features may be significantly damaged. Unfortunately, because the slurry is a suspension, the abrasive particles in the slurry have a tendency to agglomerate, forming relatively large clumps when compared to semiconductor device sizes. While these clumps of abrasive can grow to significant size, e.g., 0.1 $\mu$m to 30 $\mu$m, depending in part upon their initial abrasive particle size, they retain their ability to abrade the semiconductor wafer surface. The agglomeration problem is most apparent when the slurry is allowed to stand. If the slurry is allowed to stand in the supply line for any appreciable time, the agglomeration begins and sometimes clogs the supply line. This results in the need to stop the processing and flush the supply line. Of course, once the supply line is flushed, the stabilized slurry must be reflowed through the line, forcing any residual water from the line. This entire process is time consuming and ultimately very expensive when the high cost of the wasted slurry and the lost processing time is considered. Agglomeration is especially a problem in metal planarization slurries.

To help alleviate this agglomeration problem, the conventional approach has been to keep the slurry flowing in a loop and to perform a coarse filter of the slurry while it is in the loop. To supply the slurry to the polishing platen, the loop is tapped, and the slurry is subjected to a point-of-use, final filter just before it is applied to the polishing platen. However, as the final filter strains out the larger particles, the filter becomes clogged, raising the flow pressure required and necessitating a filter change or cleaning operation. The increased pressure may deprive the polishing platen of slurry and endanger the planarization process. Cleaning or changing the filter clearly interrupts the CMP processing. Naturally, cleaning or replacing the filter is both time consuming and costly. Further, as the filters are extremely fine (capable of passing particles less than about 10 $\mu$m to 14 $\mu$m in size), the filters themselves represent a significant cost. Additionally, when the processing is stopped to clean/replace the filter, the slurry supply line must be flushed with water to prevent even more agglomerate from forming. This flushing water initially dilutes the slurry when processing resumes, further delaying the CMP process. Unfortunately, even when the filters are flushed regularly, the filters may only last for a period of a few days or even hours, depending upon the daily processing schedule. Furthermore, these filters still allow particles that have particle sizes larger than the intended design particle size to reach the polishing surface.

Accordingly, what is needed in the art are a slurry delivery system and method of use thereof which efficiently breaks up the CMP slurry agglomerate, and returns the slurry particulate matter substantially to the design particle size.

SUMMARY OF THE INVENTION

To address the above-discussed deficiencies of the prior art, the present invention, in one embodiment, provides a method for eliminating agglomerate particles in a polishing slurry. In this particular embodiment, the method includes transferring a slurry that has a design particle size from a slurry source to an energy source. In many instances, the slurry forms an agglomerate that has an agglomerated particle size, which is substantially larger than the design particle size. This larger particle size is highly undesirable because it can damage the semiconductor wafer surface as it is polished. The method further includes subjecting the agglomerate to energy, such as an ultra sonic wave, emanating from the energy source and transferring energy from the energy source to the slurry to reduce the agglomerated particle size to substantially the design particle size. As used herein the phrase "to substantially the design particle size" means that the agglomerated particle is reduced to a size that ranges from about 100% to about 400% of the design particle size for a given slurry.

Thus, one aspect of the present invention provides a method where agglomerated particles are reduced in size without the need of filters. This aspect of the present invention, therefore, provides definite advantages over the devices and systems of the prior art. For example, since the agglomerated particles are being reduced substantially to the design particle size by an energy source and not by filters, it is not necessary to frequently shut down the process to change the filters. Thus, filter costs are not only saved but production down time is also saved, which of course, increases efficiency and decreases overall production costs.

The design size of the slurry's particles may vary depending on the particular slurry. However, in one aspect of the present invention, the designed particle size ranges from about 1.5 $\mu$m to about to about 0.012 $\mu$m, and more particularly may range from about 0.025 $\mu$m to about 0.050 $\mu$m.

The present invention as encompasses the uses of various type of devices that could be used to reduce the size of an agglomerated particle. However, in one particular embodiment, the energy is generated from a radio frequency generator. In one particular aspect, the radio frequency generator is capable of generating an energy wave having a frequency ranging from about 1 mega Hertz to about 15 mega Hertz. Typically this frequency will produce an energy wave having a power of 20 watts.

While the size of the agglomerated particle may depend on several processing factors, such as viscosity, system pressures and temperatures, and the input or designed particle size, normal operating conditions for such a system will typically form agglomerated particles that have particle sizes ranging from about 0.1 $\mu$m to about 30 $\mu$m before the energy pulse.

The slurries used in the present invention are typically well known to those who are skilled in the art and will, of course, vary and depend on the type of polishing procedure. However, in one embodiment, the slurry is a metal slurry having an abrasive with a design particle size ranging from about 0.12 $\mu$m to about 1.50 $\mu$m. In another embodiment, the slurry is an oxide slurry having an abrasive with a design particle size ranging from about 0.05 $\mu$m to about 0.012 $\mu$m.

Another aspect of the present invention provides a system for eliminating agglomerate particles in a polishing slurry. In such embodiments, the system may include a chemical/mechanical polishing apparatus having a polishing surface associated therewith, a slurry source comprising a slurry having a design particle size, a slurry delivery system having a slurry dispensing end that is configured to transfer the slurry from the slurry source to the polishing surface positioned near the slurry dispensing end, and an energy source that is positioned near the dispensing end and that is configured to transfer energy to the slurry to reduce the agglomerated particle size to substantially the design particle size. The energy source may comprise a radio frequency generator configured to generate an energy wave having a frequency ranging from about 1 mega Hertz to about 15 mega Hertz. The energy source may further include a 24 volt power source, an energy wave guide and an ultra sonic dispenser nozzle. In a more specific embodiment, the slurry delivery system may further include a main slurry loop having a dispensing end located near the polishing table and the energy source, a slurry pump that is connected to the main slurry loop and that is configured to pump the slurry to the polishing surface, and a valve system configured to route the slurry through the slurry delivery system.

The foregoing has outlined, rather broadly, preferred and alternative features of the present invention so that those who are skilled in the art may better understand the detailed description of the invention that follows. Additional features of the invention will be described hereinafter that form the subject of the claims of the invention. Those who are skilled in the art should appreciate that they can readily use the disclosed conception and specific embodiment as a basis for designing or modifying other structures for carrying out the same purposes of the present invention. Those who are skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which:

FIG. 2 illustrates a table of representative, commercially available slurries from one manufacturer for use with the present invention.

DETAILED DESCRIPTION

To address the deficiencies of the prior art, the present invention provides a unique chemical/mechanical planarization (CMP) slurry delivery system that can eliminate agglomeration that occur in a slurry used in polishing or planarizing a semiconductor wafer. The general method of planarizing the surface of a semiconductor wafer, using CMP polishing, and the new and improved slurry delivery system will now be described in detail. The method may be applied when planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers.

Figure 1A:
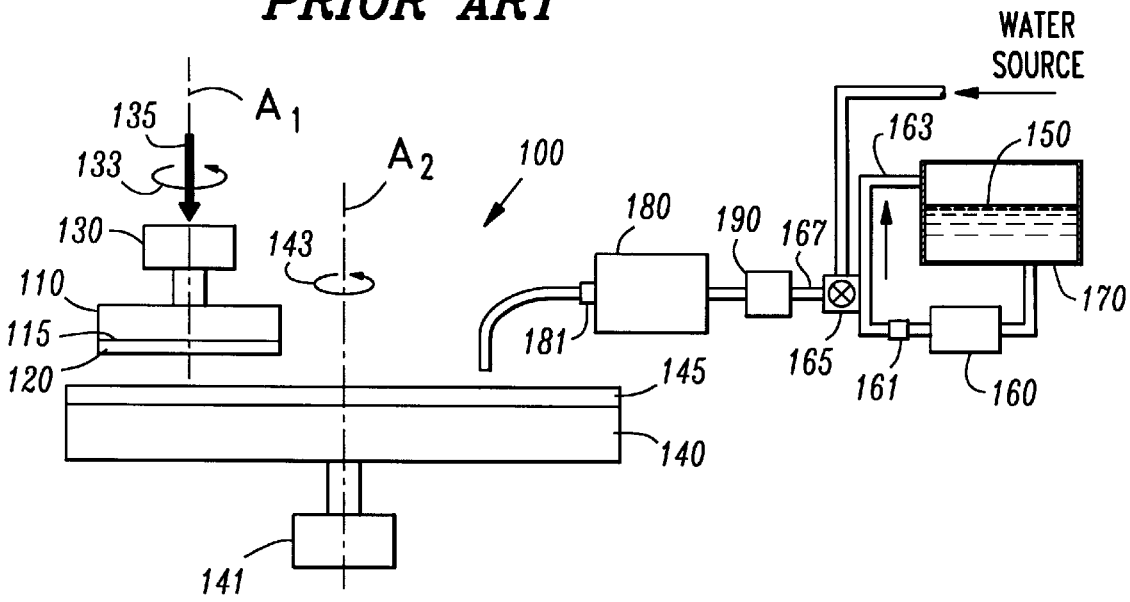
FIG. 1A PRIOR ART
FIGS. 1A and 1B illustrate schematic sectional and plan views of an exemplary embodiment of a conventional chemical/mechanical planarization (CMP) apparatus for use in accordance with the method of the current invention.

Referring initially to FIG. 1A, illustrated is a schematic sectional view of an exemplary embodiment of a conventional chemical/mechanical planarization (CMP) apparatus for use in accordance with the method of the invention. The CMP apparatus 100 may be of a conventional design that includes a wafer carrier or polishing head 110 for holding a semiconductor wafer 120. The wafer carrier 110 typically comprises a retaining ring 115, which is designed to retain the semiconductor wafer 120. The wafer carrier 110 is mounted to a drive motor 130 for continuous rotation about axis $A_1$ in a direction indicated by arrow 133. The wafer carrier 110 is adapted so that a force indicated by arrow 135 is exerted on the semiconductor wafer 120. The CMP apparatus 100 further comprises a polishing platen 140 mounted to a second drive motor 141 for continuous rotation about axis $A_2$ in a direction indicated by arrow 143. A polishing pad 145 formed of a material, such as blown polyurethane, is mounted to the polishing platen 140, which provides a polishing surface for the process. During CMP, a polishing slurry 150, which comprises an abrasive material in a colloidal suspension of either a basic or an acidic solution, is dispensed onto the polishing pad 145. In a particularly advantageous embodiment, the abrasive material may be amorphous silica or alumina and has a design, i.e., specification, particle size chosen for the material being polished. During CMP, the polishing slurry 150 is continuously pumped by a main slurry pump 160 from a slurry source tank 170, through a primary filter 161, around a main slurry loop 163, then back to the slurry source tank 170. A portion of the polishing slurry 150 circulating in the main slurry loop 163 is diverted through a three-way solenoid valve 165 to a slurry delivery conduit 167 and pumped to a dispensing mechanism 180, through a final filter 181, and onto the polishing pad 145 by a slurry delivery pump 190. This final filter 181 is only effective in removing agglomerated particles greater than 10 $\mu$m in size. With linewidths at 0.25 $\mu$m, these agglomerated particles can severely damage the interconnect circuits. A water source is coupled to the solenoid valve 165 for flushing the slurry delivery conduit 167, the dispensing mechanism 180, and the slurry delivery pump 190.

Figure 1B:
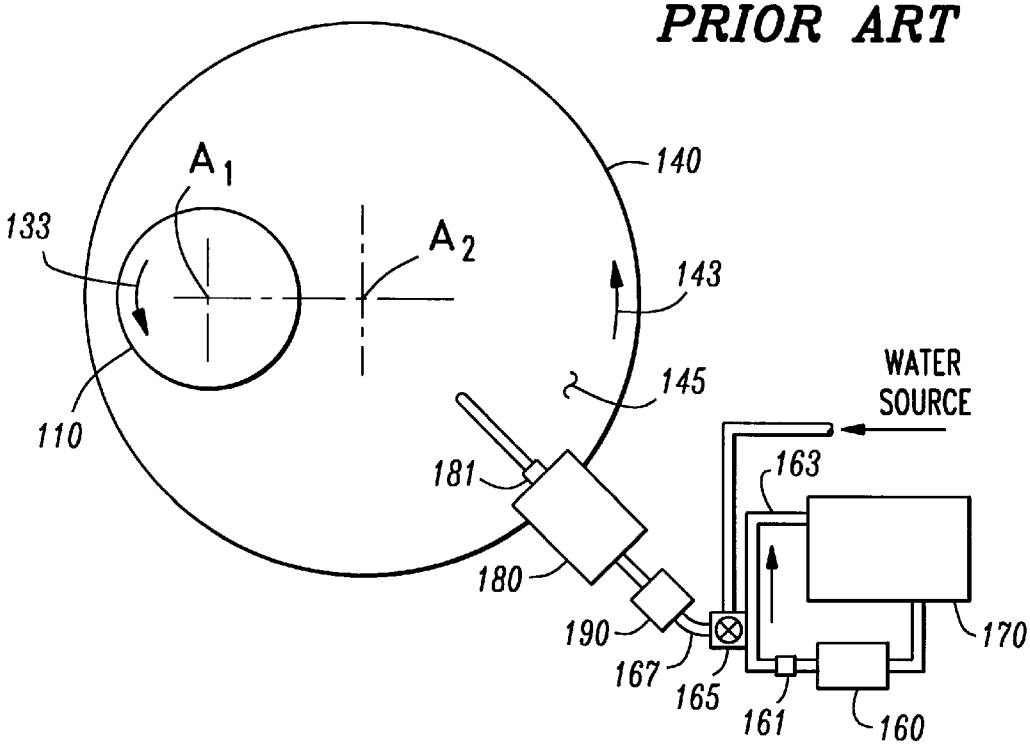
FIG. 1B PRIOR ART

Referring now to FIG. 1B, illustrated is a schematic plan overhead view of the CMP apparatus of FIG. 1A with the key elements shown. The wafer carrier 110 is shown to rotate in a direction indicated by arrow 133 about the axis $A_1$. The polishing platen 140 is shown to rotate in a direction indicated by arrow 143 about the axis $A_2$. Controlled by the three-way solenoid valve 165, the polishing slurry 150 is dispensed onto the polishing pad 145, through the delivery conduit 167 and the dispensing mechanism 180, from the slurry source tank 170. Those who are skilled in the art are familiar with the operation of a conventional CMP apparatus.

Referring now to FIG. 2 with continuing reference to FIGS. 1A and 1B, illustrated is a table of representative, commercially available slurries from one manufacturer for use with the present invention. Commercially available slurries, generally designated 200, with Solution Technology Incorporated product designations (Column 210) shown, comprise abrasive particles of alumina or amorphous silica (Column 220) held in colloidal suspension in selected chemicals (Column 230) at the concentrations (Column 240) and design pH (Column 250) shown. The selected chemicals 230 etch or oxidize a selected material (Column 270) on the semiconductor wafer 120. As can be seen in Column 260, the slurry particles of alumina or amorphous silica 220 have design, i.e., specification, particle sizes ranging from about 0.012 microns to about 1.5 microns.

Figure 3:
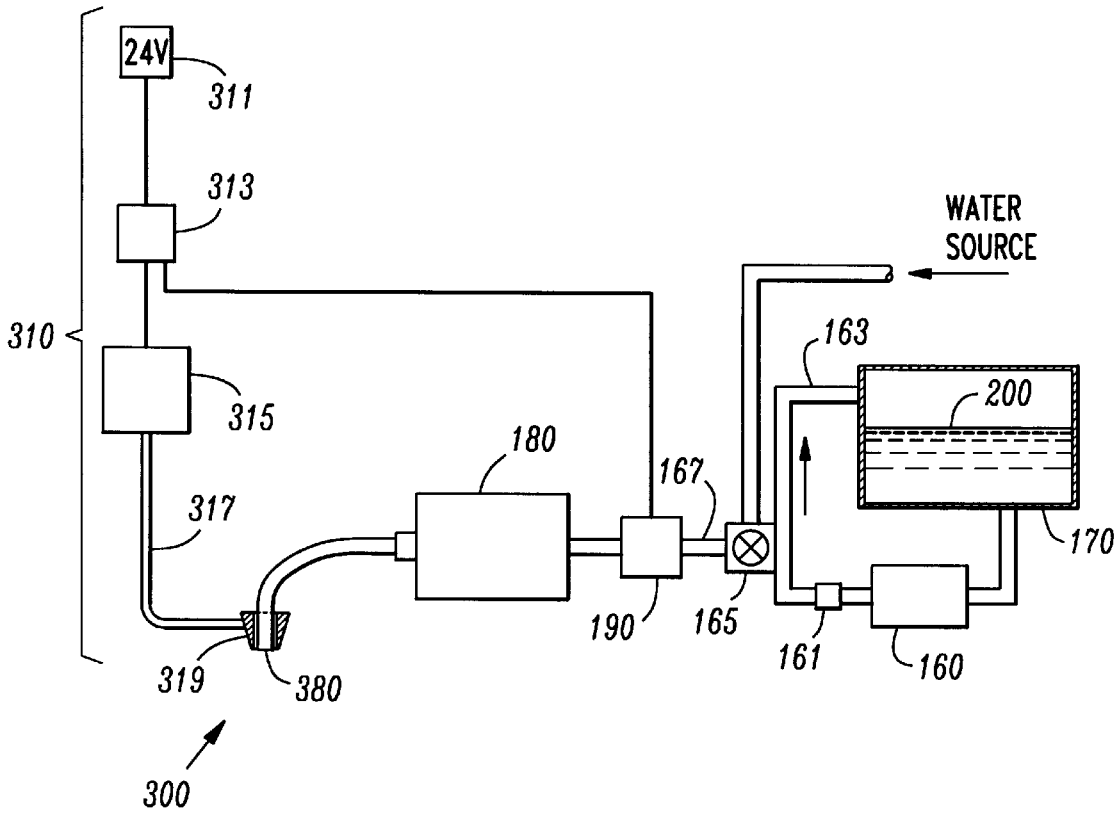
FIG. 3 illustrates a schematic view of one embodiment of an improved CMP slurry delivery system constructed according to the principles of the present invention.

Referring now to FIG. 3, illustrated is a schematic view of one embodiment of an improved CMP slurry delivery system constructed according to the principles of the present invention. An improved CMP slurry delivery system, generally designated 300, comprises the essential elements of the conventional slurry delivery system of FIGS. 1A and 1B, i.e., the slurry source tank 170, the main slurry pump 160, the primary filter 161, the main slurry loop 163, the three-way solenoid valve 165, the slurry delivery conduit 167, the slurry dispensing mechanism 180, and the slurry delivery pump 190.

The improved CMP slurry delivery system 300 may further comprise an energy source 310. In one advantageous embodiment, the energy source 310 comprises a 24 volt power source 311, a power control solenoid 313, a radio frequency generator 315, an RF coax cable 317, and an ultrasonic dispenser nozzle 319. In this embodiment, the 24 volt power source 311 is electrically coupled to the radio frequency generator 315 and the slurry delivery pump 190 through the power control solenoid 313. Thus, the power control solenoid 313 controls electrical power to both the radio frequency generator 315 and the slurry delivery pump 190. The radio frequency generator 313 is further coupled to the ultrasonic dispenser nozzle 319 by the wave guide 317. The ultrasonic dispenser nozzle 319 is mechanically coupled to the output nozzle 380 of the slurry dispensing mechanism 180. In one advantageous embodiment, the radio frequency generator 313 may be capable of emitting ultrasonic energy from about 1 mega Hertz (MHZ) to about 15 MHZ and at a power of about 20 watts. In this embodiment, the ultrasonic energy transmitted to the ultrasonic dispenser nozzle 319 by the wave guide 317 is focused on the slurry 200 that is flowing through the ultrasonic dispenser nozzle 319.

With the equipment of the improved CMP slurry delivery system 300 having been described, its operation will now be discussed in an embodiment in relation to CMP of a semiconductor wafer 120 to planarize a tungsten plug layer. Referring now simultaneously to FIGS. 1A, 1B, and 3, the CMP apparatus is prepared for processing the semiconductor wafer 120. All components of the improved slurry delivery system 300 have been thoroughly cleaned from prior processes. The slurry source tank 170 is filled with an appropriate slurry 200 (e.g., MET-200) from FIG. 2 and the main slurry pump 160 is activated. In this particular embodiment, the semiconductor surface being planarized is a metal, i.e., tungsten, and the alumina abrasive particle size is about 1.5 $\mu$m. In alternative embodiments for planarizing metals, e.g., aluminum, copper, or tungsten, the alumina abrasive particle size may vary from about 0.12 $\mu$m to about 1.5 $\mu$m. In yet other alternative embodiments, the planarizing of a dielectric material, i.e., semiconductor oxides, may employ amorphous silica with particle sizes ranging from about 0.012 $\mu$m to about 0.05 $\mu$m. A person who is skilled in the art will readily appreciate that other abrasives and other particle sizes may likewise be employed with the present invention.

The slurry 200 flows through the primary slurry filter 161 and around the main slurry loop 163, then back to the slurry source tank 170. This flow will continue throughout the CMP processing. Regardless of this flow, however, experience has shown that particle agglomeration occurs. Those particles larger than the actual interstitial spacing of the primary slurry filter 161 will be captured by the filter 161. Agglomerated particles of sizes from about 0.1 $\mu$m to about 30 $\mu$m may escape capture by the filter 161, however, and be diverted to the slurry delivery conduit 167 by three-way solenoid valve 165 along with slurry particles of the design size. Moreover, experience has also shown that agglomerated particles form in the slurry delivery conduits even after passing through the filter 161.

Before CMP begins, the power control solenoid 313 is energized and applies electrical power to the slurry delivery pump 190 and the radio frequency generator 315. Agglomerated slurry particles not captured by the primary slurry filter 161 may be in the slurry 200 diverted to the slurry delivery conduit 167 and pumped through the slurry dispensing mechanism 180 by the slurry delivery pump 190.

The energized radio frequency generator 315 delivers radio frequency energy in the form of an ultrasonic wave to the ultrasonic dispenser nozzle 319 through the wave guide 317. The ultrasonic wave is of a frequency from about 1 MHZ to about 15 MHZ and at a power of about 20 watts. When the slurry 200 passes through the ultrasonic dispenser nozzle 319, the ultrasonic wave transmitted from the radio frequency generator 313 is focused by the nozzle 319 on the slurry 200. The ultrasonic energy transferred to the slurry 200 is absorbed by the agglomerated particles. One who is skilled in the art is familiar with the mechanism by which energy in the form of an ultrasonic wave is used to break up particulate material. In a preferred embodiment, the frequency of the ultrasonic energy applied to the slurry 200 is selectively controlled at a frequency between about 1 MHZ and about 15 MHZ, with a power of about 20 watts, so as to reduce the agglomerated particle size to substantially the design particle size for the slurry product 200 in use. The output power and frequency of the radio frequency generator 315 is carefully controlled so that the agglomerated particles are not reduced in size below the design particle size.

From the foregoing, it is apparent that the present invention provides a method and system for eliminating agglomerate particles in a polishing slurry. The method includes transferring a slurry that has a design particle size from a slurry source to an energy source. In many instances, the slurry forms an agglomerate that has an agglomerated particle size, which is substantially larger than the design particle size. This larger particle size is highly undesirable because it can damage the semiconductor wafer surface as it is polished. The method further includes subjecting the agglomerate to energy, such as an ultra sonic wave, emanating from the energy source and transferring energy from the energy source to the slurry to reduce the agglomerated particle size to substantially the design particle size. As previously discussed, another aspect of the present invention provides a system for eliminating agglomerate particles in a polishing slurry. In such embodiments, the system may include a chemical/mechanical polishing apparatus having a polishing surface associated therewith, a slurry source comprising a slurry having a design particle size, a slurry delivery system having a slurry dispensing end that is configured to transfer the slurry from the slurry source to the polishing surface positioned near the slurry dispensing end, and an energy source that is positioned near the dispensing end and that is configured to transfer energy to the slurry to reduce the agglomerated particle size to substantially the design particle size.

Although the present invention has been described in detail, those who are skilled in the art should understand that they can make various changes, substitutions and alterations herein without departing from the spirit and scope of the invention in its broadest form.

What is claimed is:

1. A method for reducing agglomerate particles in a polishing slurry having a design particle size that is to be dispensed by a slurry dispensing system, comprising:

transferring said polishing slurry by said slurry dispensing system from a slurry source to an energy source coupled to said slurry dispensing system, said slurry forming an agglomerate within said slurry dispensing system, said agglomerate having an agglomerated particle size substantially larger than said design particle size;

subjecting said agglomerate to energy emanating from said energy source; and transferring energy from said energy source to said agglomerate to reduce said agglomerated particle size to substantially said design particle size.

2. The method as recited in claim 1 wherein said energy source is an ultrasonic transducer and said transferring includes transferring energy from said energy source to said agglomerate by an ultrasonic wave.

3. The method as recited in claim 1 wherein said design particle size ranges from about 1.5 $\mu$m to about to about 0.012 $\mu$m.

4. The method as recited in claim 3 wherein said design particle size ranges from about 0.025 $\mu$m to about 0.050 $\mu$m.

5. The method as recited in claim 1 wherein said subjecting includes generating said energy from a radio frequency generator.

6. The method as recited in claim 5 wherein generating includes producing an energy wave having a frequency ranging from about 1 mega Hertz to about 15 mega Hertz.

7. The method as recited in claim 6 wherein producing said energy wave includes producing an energy wave having a power of 20 watts.

8. The method as recited in claim 1 wherein said agglomerated particle size ranges from about 0.1 $\mu$m to about 30 $\mu$m.

9. The method as recited in claim 1 wherein said slurry is a metal slurry having an abrasive with a design particle size ranging from about 0.12 $\mu$m to about 1.50 $\mu$m.

10. The method as recited in claim 1 wherein said slurry is an oxide slurry having an abrasive with a design particle size ranging from about 0.05 $\mu$m to about 0.012 $\mu$m.

11. A system for reducing agglomerate particles in a polishing slurry having a design particle size that is to be dispensed, comprising:

a chemical/mechanical polishing apparatus having a polishing surface associated therewith;

a slurry source containing said polishing slurry;

a slurry dispensing system having a slurry dispensing end and configured to transfer said polishing slurry from said slurry source to said polishing surface positioned near said slurry dispensing end, said polishing slurry forming an agglomerate within said slurry dispensing system, said agglomerate having an agglomerated particle size substantially larger than said design particle size; and an energy source coupled to said dispensing end and configured to transfer energy to said agglomerate to reduce said agglomerated particle size to substantially said design particle size.

12. The system as recited in claim 11 wherein said energy source is an ultrasonic transducer configured to radiate an ultrasonic energy wave.

13. The system as recited in claim 11 wherein said design particle size ranges from about 1.5 $\mu$m to about to about 0.012 $\mu$m.

14. The system as recited in claim 13 wherein said design particle size ranges from about 0.025 $\mu$m to about 0.050 $\mu$m.

15. The system as recited in claim 11 wherein said energy source comprises a radio frequency generator configured to generate an energy wave having a frequency ranging from about 1 mega Hertz to about 15 mega Hertz.

16. The system as recited in claim 15 wherein said energy source further comprises a 24 volt power source, an energy wave guide and an ultrasonic dispenser nozzle.

17. The system as recited in claim 11 wherein said slurry dispensing system further includes a main slurry loop having a dispensing end located near said polishing surface, said dispensing end coupled to said energy source, a slurry pump connected to said main slurry loop and configured to pump said slurry to said polishing surface, and a valve system configured to route said slurry through said slurry dispensing system.

18. The system as recited in claim 11 wherein said agglomerated particle size ranges from about 0.1 $\mu$m to about 30 $\mu$m.

19. The system as recited in claim 11 wherein said slurry is a metal slurry having an abrasive with a design particle size ranging from about 0.12 $\mu$m to about 1.50 $\mu$m.

20. The system as recited in claim 11 wherein said slurry is an oxide slurry having an abrasive with a design particle size ranging from about 0.05 $\mu$m to about 0.012 $\mu$m.

21. A method for polishing a semiconductor wafer, comprising:

positioning a surface of said semiconductor wafer against a polishing surface;

transferring a slurry having a design particle size from a slurry source of a slurry dispensing system to an energy source coupled to said slurry dispensing system, said slurry forming an agglomerate within said slurry dispensing system, said agglomerate having an agglomerated particle size substantially larger than said design particle size;

subjecting said agglomerate to energy emanating from said energy source;

transferring energy from said energy source to said agglomerate to reduce said agglomerated particle size to substantially said design particle size;

transferring said slurry to said polishing surface subsequent to a reduction in said agglomerated particle size; and polishing said surface of said semiconductor wafer.

22. The method as recited in claim 21 wherein said energy source is an ultrasonic transducer and said transferring includes transferring energy from said energy source to said agglomerate by an ultrasonic wave.

23. The method as recited in claim 21 wherein said design particle size ranges from about 1.5 $\mu$m to about 0.012 $\mu$m.

24. The method as recited in claim 21 wherein said subjecting includes generating said energy from a radio frequency generator having a frequency ranging from about 1 mega Hertz to about 15 mega Hertz.

25. The method as recited in claim 21 wherein said agglomerated particle size ranges from about 0.1 $\mu$m to about 30 $\mu$m.

26. A method for polishing a semiconductor wafer, comprising:

positioning a surface of said semiconductor wafer against a polishing surface;

transferring a slurry having a design particle size from a slurry source to a predispensing location prior to being dispensed on said polishing surface, said slurry forming an agglomerate;

subjecting said slurry to energy emanating from an energy source prior to dispensing said slurry on said polishing surface to reduce said agglomerated particle size; and transferring said slurry to said polishing surface and polishing said surface of said semiconductor wafer.

* * * * *